US011577175B2

(12) United States Patent
Schmid

(10) Patent No.: US 11,577,175 B2
(45) Date of Patent: Feb. 14, 2023

(54) TOY VEHICLE PLAYSET WITH INTERACTIVE OBJECT

(71) Applicant: Mattel, Inc., El Segundo, CA (US)

(72) Inventor: Paul Schmid, Ojai, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 17/167,172

(22) Filed: Feb. 4, 2021

(65) Prior Publication Data

US 2021/0245070 A1 Aug. 12, 2021

Related U.S. Application Data

(60) Provisional application No. 62/972,148, filed on Feb. 10, 2020.

(51) Int. Cl.

| | |
|---|---|
| ***A63H 18/02*** | (2006.01) |
| ***A63H 18/16*** | (2006.01) |
| ***A63H 18/00*** | (2006.01) |
| ***A63H 11/00*** | (2006.01) |

(52) U.S. Cl.

CPC ..... *A63H 18/028* (2013.01); *A63H 11/00* (2013.01); *A63H 18/00* (2013.01); *A63H 18/16* (2013.01)

(58) Field of Classification Search

CPC ..... A63H 18/00; A63H 18/02; A63H 18/025; A63H 18/026; A63H 18/028; A63H 18/06; A63H 18/16; A63H 13/20; A63H 11/00

See application file for complete search history.

(56) References Cited

U.S. PATENT DOCUMENTS

| | | | | |
|---|---|---|---|---|
| 1,482,976 A * | 2/1924 | Downey | A63H 27/04 472/7 |
| 1,802,139 A * | 4/1931 | Dacey, Jr. | A63H 27/04 472/9 |
| 1,817,751 A | 8/1931 | Long | |
| 1,880,604 A * | 10/1932 | Vandergon | A63H 33/40 40/422 |
| 2,417,565 A | 3/1947 | Norvell | |
| 3,103,362 A | 9/1963 | Elofson | |
| 3,207,515 A | 9/1965 | Mireider | |
| 3,713,251 A * | 1/1973 | Marason, Jr. | A63H 3/50 446/241 |

(Continued)

*Primary Examiner* — Eugene L Kim
*Assistant Examiner* — Alyssa M Hylinski
(74) *Attorney, Agent, or Firm* — Edell, Shapiro & Finnan, LLC

(57) ABSTRACT

An improved toy vehicle playset contains a base, a tower, a launcher, and a housing structure. The tower may be equipped with a track disposed around the tower. An interactive object may be moveably coupled to the tower and equipped with a mechanism that is repositionable between an engaged position, where the mechanism is engaged with the track of the tower, and a disengaged position, where the mechanism is disengaged from the track of the tower. When in the mechanism is in the engaged position, the interactive object may descend the tower along the track. When the mechanism is in the disengaged position, the interactive object may descend linearly or fall along the tower without following the track. The launcher may be configured to launch toy vehicles at the interactive object to actuate the mechanism to be repositioned from the engaged position to the disengaged position.

15 Claims, 15 Drawing Sheets

(56) References Cited

U.S. PATENT DOCUMENTS 4,109,410 A * 8/1978 Saitoh ..... A63H 18/04 446/178
4,128,964 A 12/1978 Ogasawara
4,219,198 A 8/1980 Meyer et al.
4,531,736 A * 7/1985 Sahler ..... A63B 63/00 273/127 R
4,689,034 A 8/1987 Dubois et al.
6,663,464 B2 12/2003 Payne et al.
7,537,509 B2 5/2009 Payne et al.
7,614,931 B2 11/2009 Nuttall
7,753,753 B2 7/2010 Payne et al.
7,794,301 B2 9/2010 Ostendorff et al.
8,057,276 B2 11/2011 O'Connor
8,162,716 B2 4/2012 Nuttall
8,182,308 B2 5/2012 Payne
8,262,473 B2 9/2012 Civettini et al.
8,444,151 B2 5/2013 Moran et al.
8,628,373 B2 1/2014 Payne
9,504,926 B2 * 11/2016 O'Connor ..... A63H 18/023
9,586,154 B2 3/2017 Lau et al.
9,707,489 B2 7/2017 Nuttall et al.
2008/0051001 A1 * 2/2008 Nuttall ..... A63H 18/023 446/444
2012/0061484 A1 * 3/2012 Payne ..... A63H 18/10 238/10 A
2013/0183884 A1 * 7/2013 Catanzaro ..... A63H 33/26 446/485
2015/0093964 A1 * 4/2015 Schmid ..... A63H 17/44 446/476
2015/0097043 A1 * 4/2015 Lau ..... A63H 18/16 238/10 F
2016/0206966 A1 7/2016 Nuttal et al.
2016/0310857 A1 * 10/2016 Effler ..... A63H 18/02
2019/0060772 A1 2/2019 Hamel et al.
2019/0105578 A1 4/2019 Brous

* cited by examiner

TOY VEHICLE PLAYSET WITH INTERACTIVE OBJECT

CROSS-REFERENCE TO RELATED APPLICATIONS

This application claims priority under 35 U.S.C. 119(e) to U.S. Provisional Patent Application Ser. No. 62/972,148, entitled "Toy Vehicle Playset With Interactive Object," filed Feb. 10, 2020, the disclosure of which is incorporated herein by reference in its entirety for all purposes.

FIELD OF THE INVENTION

The present invention relates to a toy vehicle playset, and in particular, a toy vehicle playset with an interactive feature or object. More specifically, the interactive feature or object is movable with respect to the toy vehicles and the playset itself, and is capable of interacting with toy vehicles disposed on the toy vehicle playset in order to provide unique play patterns with the toy vehicle playset.

BACKGROUND OF THE INVENTION

Various toy vehicle playsets are known, where many of the known toy vehicle playsets are used to simulate raceways, cityscapes, and/or other backdrops. In some instances, the toy vehicle playsets may include a tower, but these playsets are limited in their play patterns because their towers often lack interactive features. Instead, the towers of the conventional toy vehicle playsets are merely included for appearances rather than creating unique play patterns.

Therefore, there is a need for a toy vehicle playset that includes a tower from which at least one interactive feature or object descends in a manner that creates a unique play pattern for the toy vehicle playset.

SUMMARY OF THE INVENTION

The present invention disclosed herein is a toy vehicle playset that contains a base, a tower ascending from the base, a launcher coupled to the base, and a housing structure coupled to the base. The tower may be equipped with a track that is disposed around the tower from the top end to the bottom end of the tower. In some embodiments, the track is a helical track that spirals around the tower. An interactive object may be moveably coupled to the tower and equipped with an engagement mechanism that is repositionable between an engaged position, where a portion of the engagement mechanism is engaged with the track of the tower, and a disengaged position, where the portion of the engagement mechanism is disengaged from the track of the tower. When in the engagement mechanism is in the engaged position, the interactive object may descend the tower along the track. When the engagement mechanism is in the disengaged position, the interactive object may descend the tower linearly along the length of the tower without following the track. The launcher may be configured to launch toy vehicles at the interactive object to actuate the engagement mechanism to reposition from the engaged position to the disengaged position.

In one embodiment, the present invention disclosed herein is a toy vehicle playset that includes a base, a tower, and a movable object. The tower may be coupled to the base, and may include a track disposed about the tower. The object may be moveably coupled to the tower, and may include an actuator and a repositionable mechanism. The mechanism may be repositionable between an engaged position and a disengaged position. In the engaged position, the mechanism may be engaged with the track of the tower. In the disengaged position, the mechanism may be disengaged from the track of the tower. Actuation of the actuator may reposition the mechanism from the engaged position to the disengaged position.

In at least some instances, the track may be a helical track. In further instances, when the mechanism of the object is in the engaged position and engaged with the helical track, the object may be configured to spiral around the tower as the object descends the tower. Still further, when the mechanism of the object is in the disengaged position, the object may be configured to fall vertically (or linearly) along the tower toward the base.

In even some further instances, the toy vehicle playset may include a toy vehicle launcher that may be coupled to the base. The toy vehicle launcher may be configured to launch toy vehicles toward the tower and the object. Additionally, when a toy vehicle launched by the toy vehicle launcher impacts the actuator of the object, the mechanism of the object may be repositioned from the engaged position to the disengaged position.

In yet some even further instances, the mechanism may include at least one gear that may be configured to rotate when the mechanism is in the engaged position and the object descends the tower. In at least some instances, the object may further include at least one movable member that may be operatively coupled to the at least one gear of the mechanism such that the at least one movable member may be configured to perform a movement when the mechanism is in the engaged position and the object descends the tower along the track.

According to another embodiment, the present invention disclosed herein is a toy vehicle playset that may include a base, a tower, and a moveable object. The tower may be coupled to the base, and may include a track disposed about the tower. The object may be moveably coupled to the tower, and may include an actuator. The object may be reconfigurable between a first configuration and a second configuration. In the first configuration, the object may be configured to descend the tower along the track. In the second configuration, the object may be configured to linearly descend the tower. Actuation of the actuator may reconfigure the object from the first configuration to the second configuration.

In at least some instances, the object may include a first portion and a second portion, where the first portion may be rotatably coupled to the second portion. Additionally, the second portion may include an opening configured to receive the tower such that second portion at least partially surrounds a portion of the tower. In some further instances, the first portion may be configured to rotate between a first position and a second position. The first portion may be configured to rotate approximately 90 degrees from the first position with to the second position with respect to the second portion. In some even further instances, the object may further include a resilient mechanism that may be configured to bias the first portion to the second position.

Moreover, in some instances, the second portion may further include an engagement mechanism that is repositionable between an engaged position and a disengaged position. When the mechanism is in the engaged position, the mechanism may be engaged with the track of the tower. When the mechanism is in the disengaged position, the mechanism may be disengaged from the track of the tower. Actuation of the actuator may reposition the mechanism from the engaged position to the disengaged position. In some further instances, when the engagement mechanism is repositioned to the disengaged position, the resilient mechanism may bias the first portion of the object to the second position.

According to yet another embodiment, the present invention disclosed herein is a toy vehicle playset that may include a base, a tower, and a movable object. The tower may be coupled to, and extending vertically from, the base. The tower may include a top end and a bottom end. The object may be moveably coupled to the tower, and may include an actuator. The object may be reconfigurable between a first configuration and a second configuration. In the first configuration, the object may descend toward the bottom end of the tower at a first speed. In the second configuration, the object may descend toward the bottom end of the tower at a second speed that differs from the first speed. Actuation of the actuator may reconfigure the object from the first configuration to the second configuration.

In some instances, the tower may further include a helical track that encircles the tower, and that spans from the top end to the bottom end. Moreover, in some further instances, the object may further include an engagement mechanism operatively coupled to the actuator. The engagement mechanism being repositionable between an engaged position and a disengaged position. In the engaged position, the engagement mechanism may engage the helical track of the tower. In the disengaged position, the engagement mechanism may be disengaged from the helical track of the tower. Actuation of the actuator may reposition the engagement mechanism from the engaged position to the disengaged position.

In even some further instances, when the object is in the first configuration, the engagement mechanism may be in the engaged position, and when the object is in the second configuration, the engagement mechanism may be in the disengaged position. Moreover, the first speed may be slower than the second speed due to the engagement of the engagement mechanism with the helical track. Additionally, in some instances, the top end of the tower may comprise a securement mechanism configured to engage the object and releasably retain the object proximate to the top end of the tower.

BRIEF DESCRIPTION OF THE DRAWINGS

Like reference numerals have been used to identify like elements throughout this disclosure.

DETAILED DESCRIPTION OF THE INVENTION

Figure 1:
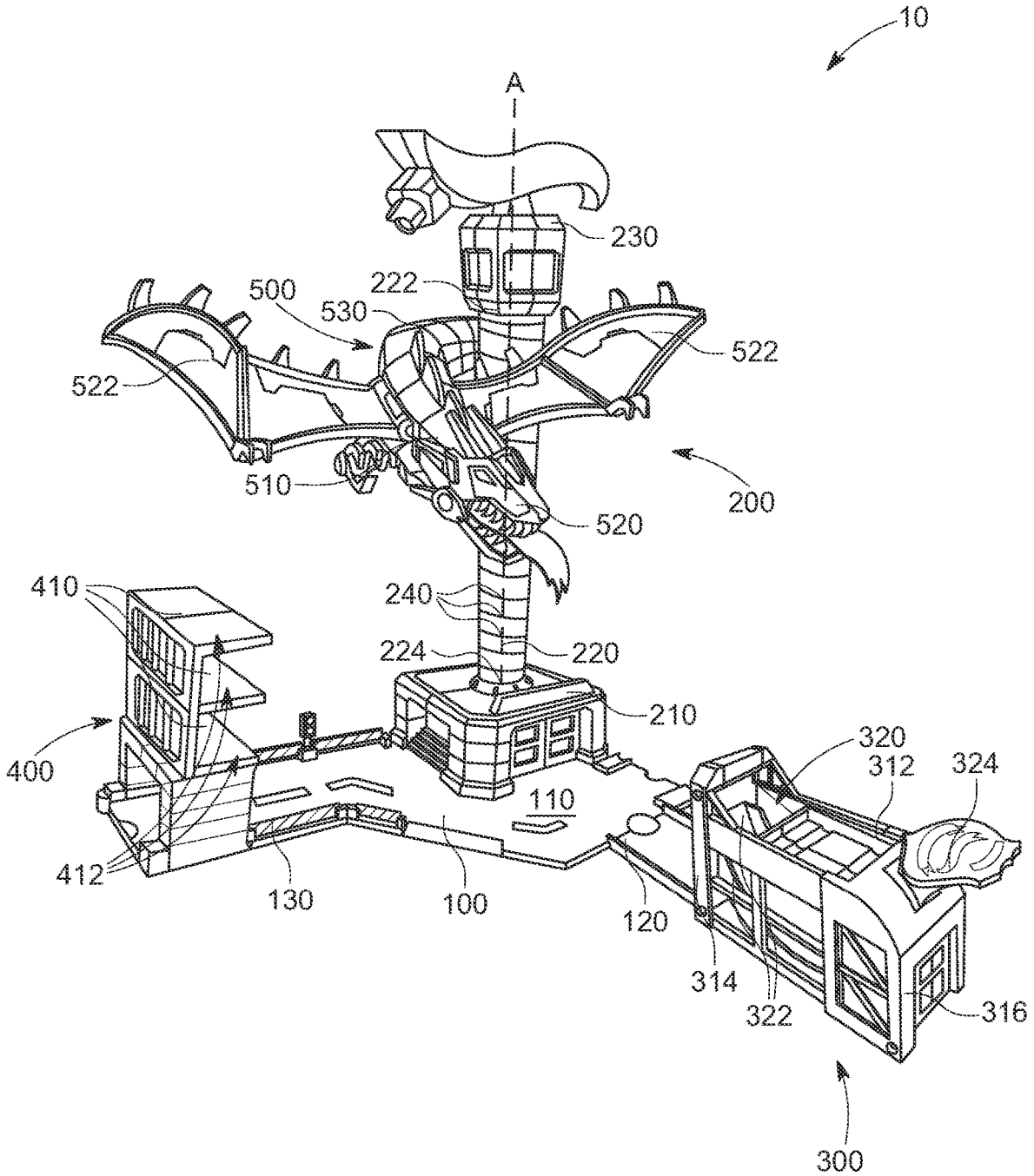
FIG. 1 illustrates a front perspective view of an embodiment of a toy vehicle playset in accordance with the present invention that includes a tower from which at least one interactive feature or object descends.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment," "an embodiment," "an exemplary embodiment," and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

The present invention disclosed herein is a toy vehicle playset that is equipped with one or more towers ascending from the base of the toy vehicle playset. An interactive feature or object may be movably coupled to the tower such that the interactive object moves with respect to the tower to provide a unique play pattern for the toy vehicle playset. More specifically, the tower may be equipped with a track along which the interactive object follows as it is actuated to descend the tower of the toy vehicle playset. In some instances, including the embodiment disclosed herein, the track of the tower may be a helical track that spirals around the tower. The interactive object may resemble a creature, animal, vehicle, or other object that may be actuated to descend the tower as the interactive object spins or swirls around the tower via the helical track. This movement of the interactive object with respect to tower gives the appearance that the interactive object is moving about the tower. The interactive object may be equipped with one or more mechanisms that enable the interactive object to selectively engage the track of the tower, and may include a trigger or actuator that may be actuated to cause the one or more mechanisms to disengage from the track of the tower, which causes the interactive object to slide or fall down the length of the tower. The embodiment of the toy vehicle playset disclosed herein may be further equipped with a toy vehicle launcher that enables a toy vehicle to be launched at the descending interactive object. When the launched toy vehicle strikes the interactive object and actuates the trigger of the one or more mechanisms, the interactive object falls down the tower due to disengagement of the one or more mechanism with the track. The disclosed toy vehicle playset may further include a structure in which toy vehicles may be disposed. The structure may be placed in proximity to the tower such that the descending interactive object may knock toy vehicles disposed within the structure off of the structure as the interactive object descends the tower along the track.

Figure 2A:
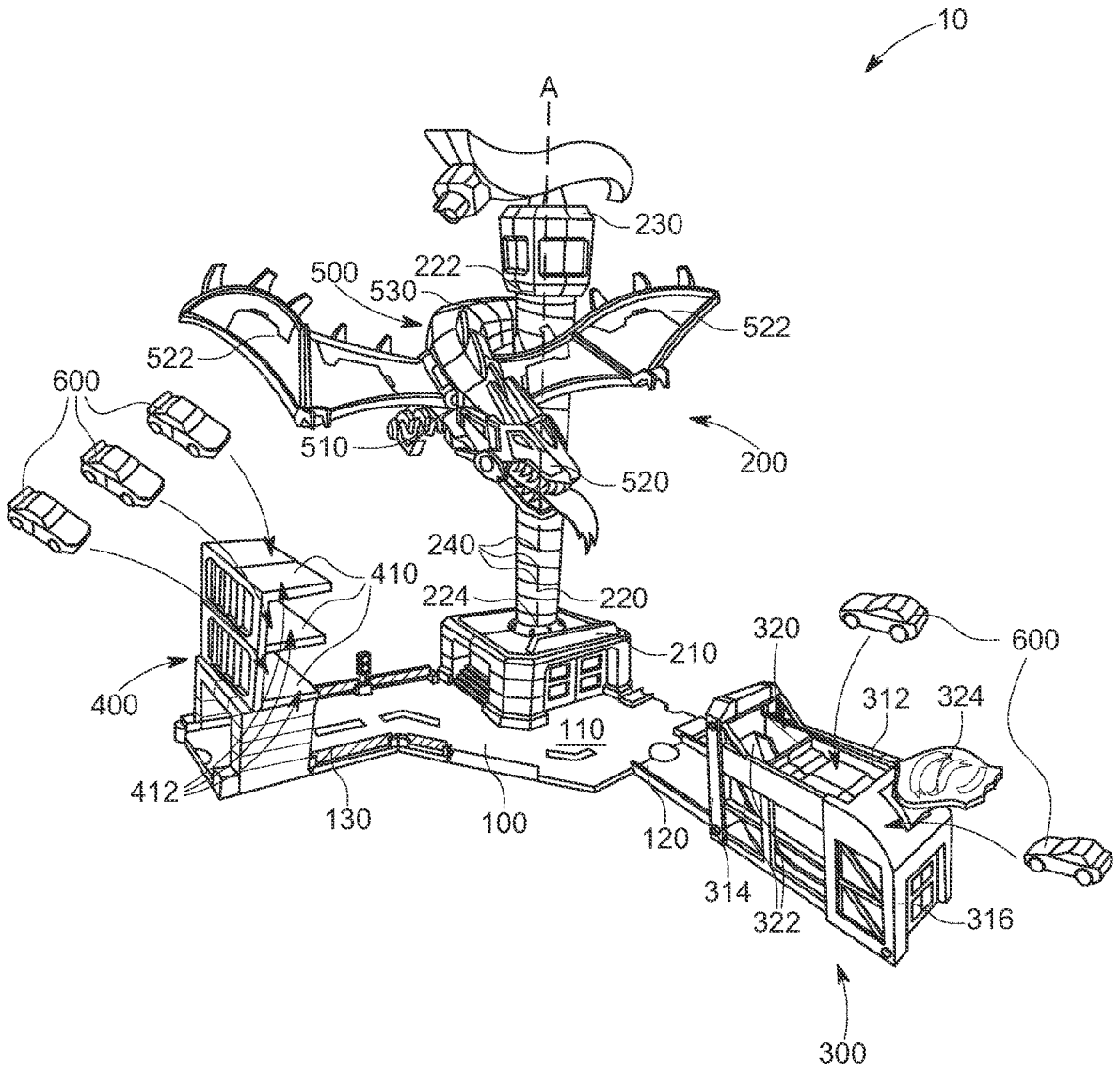
FIG. 2A illustrates a front perspective view of the embodiment of the toy vehicle playset illustrated in FIG. 1, where the figure indicates the possible placement of toy vehicles on the playset.
Figure 2B:
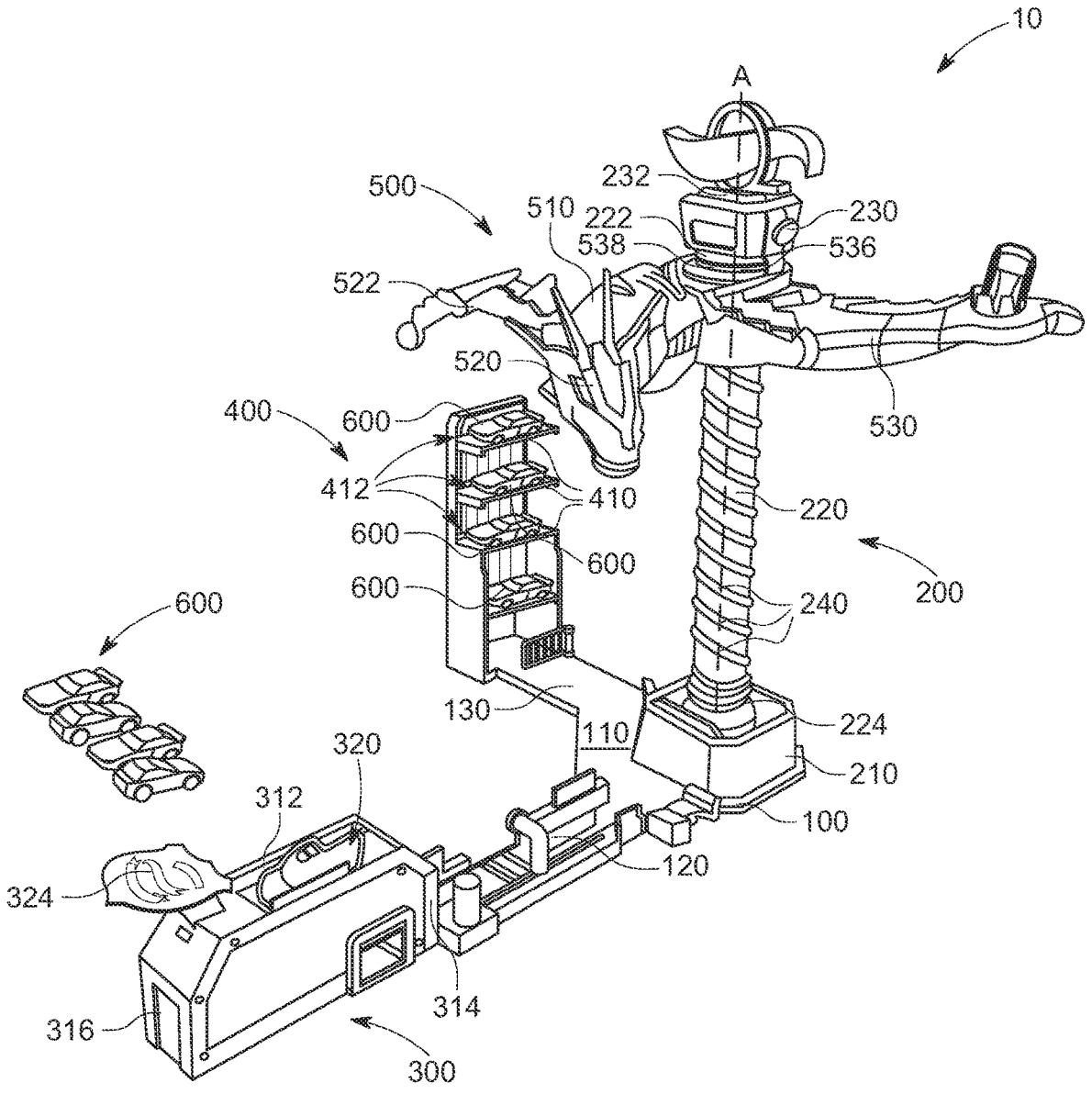
FIG. 2B illustrates a rear perspective view of the embodiment of the toy vehicle playset illustrated in FIG. 1, where the figure indicates the possible placement of toy vehicles on the playset.

Turning to FIGS. 1, 2A, and 2B, illustrated are front and rear perspective views of an embodiment of a toy vehicle playset 10. As illustrated, the toy vehicle playset 10 includes a base 100, a tower 200 that rises, ascends, or extends upwardly from the base 100, a launcher 300 coupled to the base 100, a housing structure 400 coupled to the base 100, and an interactive object 500 movably coupled to the tower 200. In the embodiment illustrated, the interactive object 500 may be in the form of a dragon having chomping jaws and flapping wings, as further detailed below. As also detailed below, the interactive object 500 is configured to simultaneously rotate around and descend the tower 200, which gives the appearance that the interactive object 500 is flying round the tower 200.

Continuing with FIGS. 1, 2A, and 2B, the base 100 of the toy vehicle playset 10 includes a top surface 110, a first track extension 120, and a second track extension 130. As illustrated, the base 100 may be substantially L-shaped, where the tower 200 is coupled to the top surface 110 of the base 100 between the first track extension 120 and the second track extension 130, or at the apex of base 100. The tower 200 may rise upwardly from the top surface 110 of the base 100 in a direction that is perpendicular to the first and second track extensions 120, 130. Coupled to the end of the first track extension 120 is the toy vehicle launcher 300, while the housing structure 400 is coupled to the end of the second track extension 130.

The tower 200, as illustrated, contains a platform 210 and a pillar 220. The platform 210 is coupled to the top surface 110 of the base 100, while the pillar 220 rises upwardly in a vertical manner from the platform 210 along, and coaxially with, axis A. More specifically, the pillar 220 includes a top end 222 and a bottom end 224, where the bottom end 224 of the pillar 220 is coupled to the platform 210 of the tower 200. As best illustrated in FIG. 2B, disposed on the top end 222 of the pillar 220 is a release or securement mechanism 230 that is configured to retain the interactive object 500 proximate to the top end 222 of the pillar 220 until a user of the toy vehicle playset 10 wishes to release the interactive object 500 from the top end 222 of the pillar 220. The release mechanism 230 may include an actuator 232 that may be used to actuate the release mechanism 230 to release the interactive object 500 from the top end 222 of the pillar 220. As further illustrated in FIGS. 1, 2A, and 2B, the pillar 220 includes a helical track 240 that spans around and down the pillar 220 in a helical or spiral manner between the top end 222 of the pillar 220 and the bottom end 224 of the pillar 220. The helical track 240 may be a recessed groove disposed within the outer surface of the pillar 220 or a protrusion that extends outwardly from the outer surface of the pillar 220.

Continuing with FIGS. 1, 2A, and 2B, the toy vehicle launcher 300, as previously explained, is coupled to the end of the first track extension 120 of the base 100. While the toy vehicle launcher 300 of the illustrated embodiment is shaped like a substantially rectangular prism, the toy vehicle launcher 300 may be of any other desired shape. The toy vehicle launcher 300 may include a top side 312, a first side 314 coupled to the top side 312 and facing the base 100, and a second side 316 coupled to the top side 312 opposite the first side 314 (i.e., facing away from the base 100). As further illustrated, the toy vehicle launcher 300 contains an opening 320 disposed within the top side 312 of the toy vehicle launcher 300 proximate to the first side 314 of the toy vehicle launcher 300. A launching ramp 322 may be disposed within the toy vehicle launcher 300 and at least partially extending into the opening 320 of the toy vehicle launcher 300. FIGS. 1, 2A, and 2B further illustrate an actuator 324 extending from the toy vehicle launcher 300 proximate to the top side 312 and the second side 316 of the toy vehicle launcher 300. Actuation of the actuator 324 may enable the toy vehicle launcher 300 to launch a toy vehicle 600 disposed within the toy vehicle launcher 300 along the launching ramp 322, out of the opening 320, and towards the tower 200 of the toy vehicle playset 10.

With continued reference to FIGS. 1, 2A, and 2B, the housing structure 400, as previously explained, is coupled to the end of the second track extension 130 of the base 100. The housing structure 400 includes a plurality of tiered platforms 410 that have open ends 412 on opposing sides of each of the tiered platforms 410. As illustrated, the housing structure 400 is shaped substantially as a rectangular prism where the tiered platforms 410 are stacked over or on top of one another, and where each of the tiered platforms 410 is configured to accept a toy vehicle 600 (as best illustrated in FIGS. 2A and 2B).

With reference to FIGS. 2A and 2B, illustrated are the locations in which the toy vehicles 600 may be disposed on the toy vehicle playset 10. Specifically, at least one toy vehicle 600 may be disposed on each of the tiered platforms 410 of the housing structure 400. In addition, at least one toy vehicle 600 may be disposed within the launcher 300 to enable the toy vehicle 600 to be launched from the launcher 300. A toy vehicle 600 may also be configured to be disposed on the top side 312 of the launcher 300. Placement of a toy vehicle 600 may facilitate ease of loading the toy vehicle 600 within the launcher 300 after launching of another toy vehicle 600 from the launcher 300.

Figure 3:
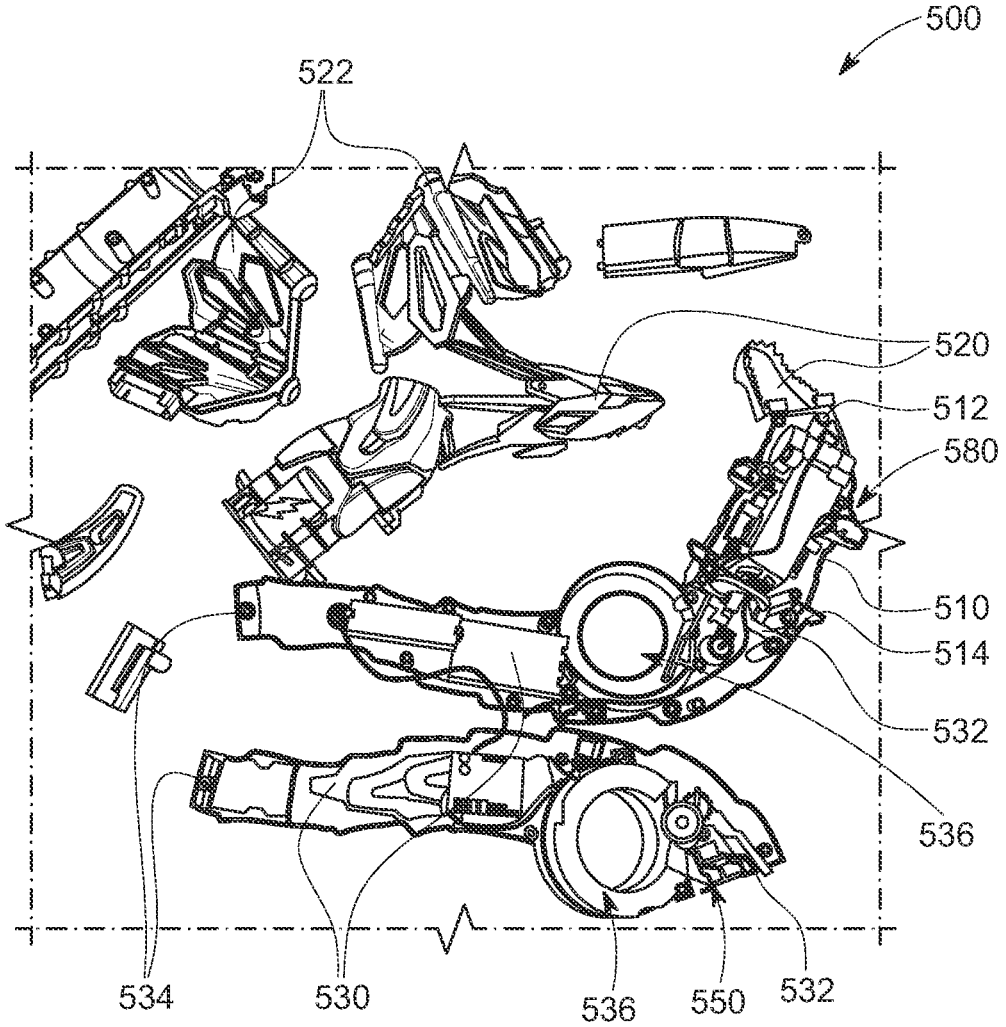
FIG. 3 illustrates a top view of the internal components of the interactive object of the toy vehicle playset illustrated in FIG. 1.
Figure 4:
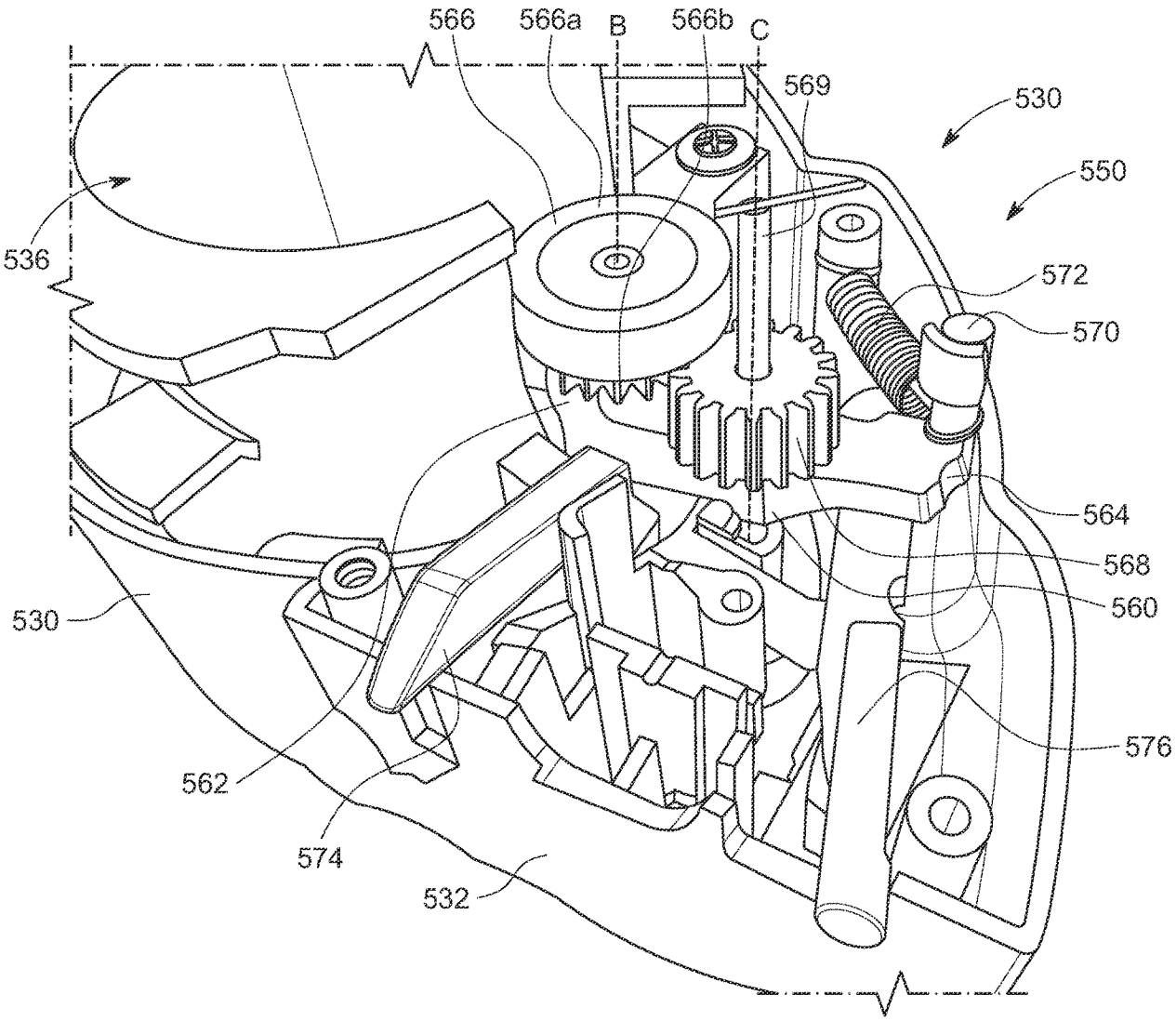
FIG. 4 illustrates a perspective view of the tower engagement mechanism of the interactive object of the toy vehicle playset illustrated in FIG. 1.
Figure 5:
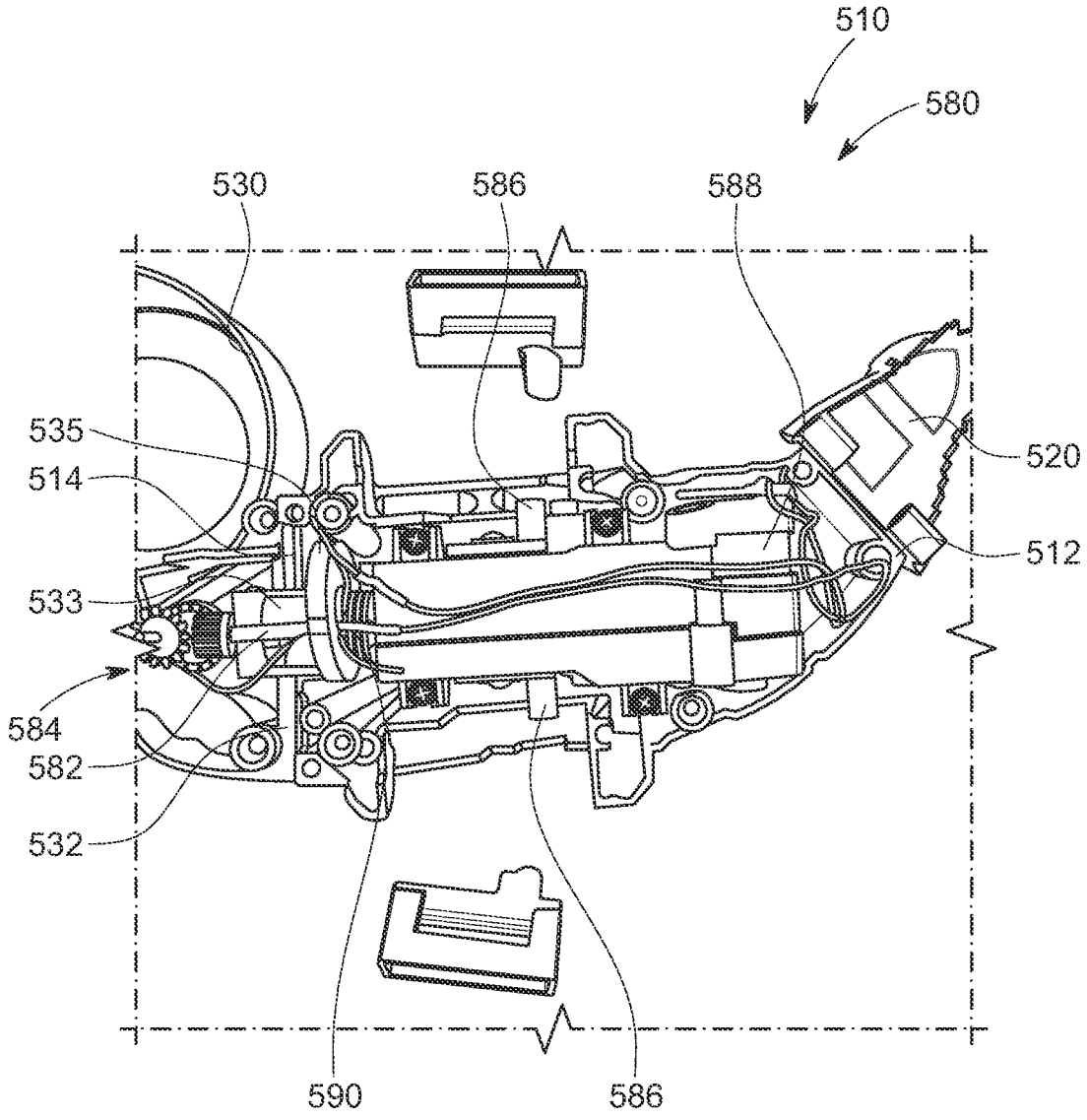
FIG. 5 illustrates a top view of the gearbox mechanism of the interactive object of the toy vehicle playset illustrated in FIG. 1.
Figure 6:
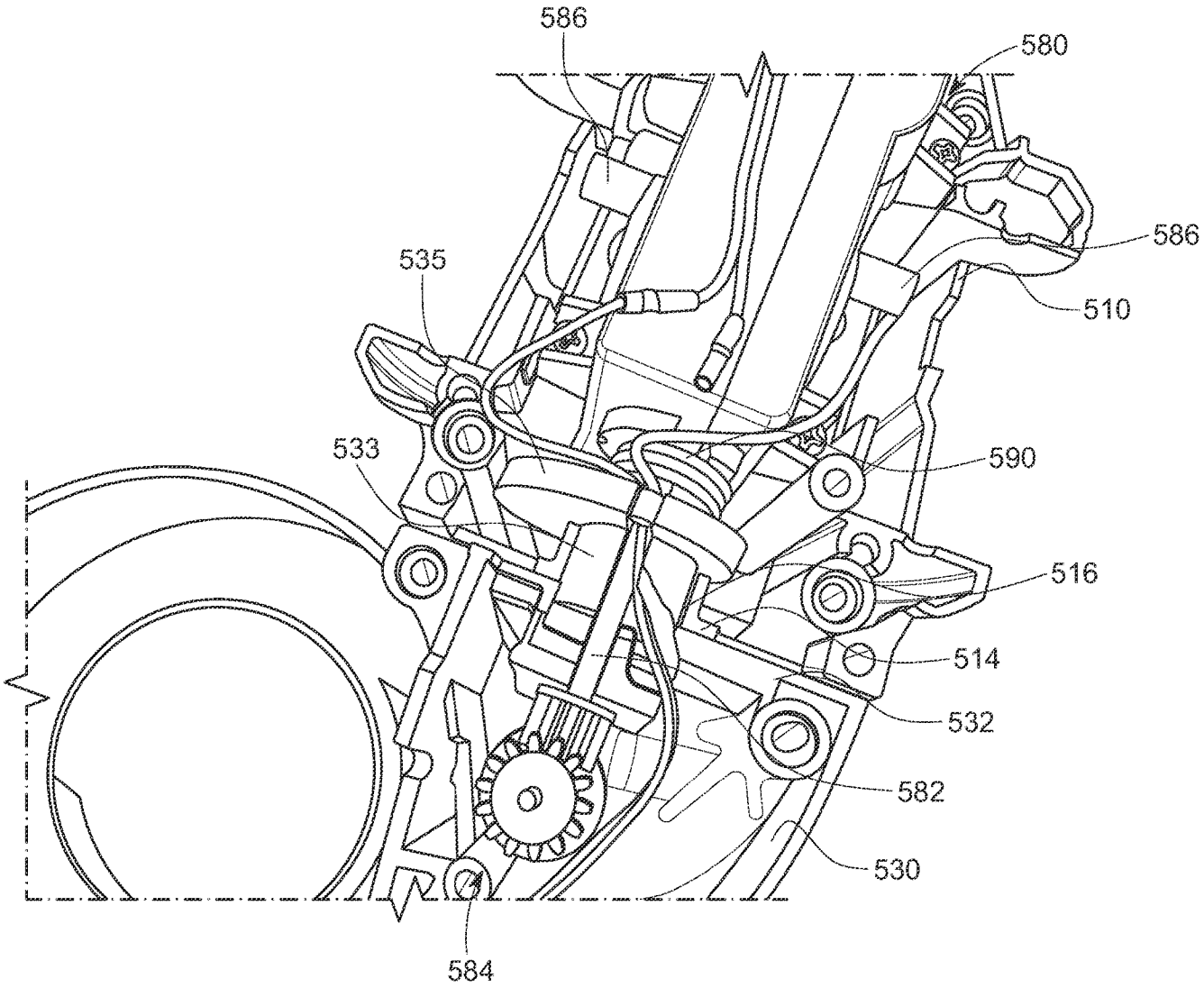
FIG. 6 illustrates a top view of the rotational connection of the first body portion of the interactive object with the second body portion of the interactive object of the toy vehicle playset illustrated in FIG. 1.

Continuing with FIGS. 1, 2A, and 2B, and with further reference to FIGS. 3-6, the interactive object 500 of the illustrated embodiment of the toy vehicle playset 10 resembles a dragon in appearance. In other embodiments, the interactive object 500 may resemble any other creature, animal, vehicle, or object, including, but not limited to, a dinosaur, a gorilla, an airplane, a helicopter, a spaceship, etc. The interactive object 500 is rotatably and slidably coupled to the pillar 220 of the tower 200 such that the interactive object 500 spirals around the pillar 220, and subsequently axis A, in a helical manner as the interactive object 500 descends the pillar 220 from the top end 222 to the bottom end 224 along the helical track 240. The illustrated embodiment of the interactive object 500 contains a first body portion 510 and a second body portion 530, where the first body portion 510 is rotatably coupled to the second body portion 530. As best illustrated in FIGS. 3 and 6, the first body portion 510 includes a first end 512 and a second end 514 opposite the first end 512, while the second body portion 530 includes a first end 532 and an opposite second end 534. The second end 514 of the first body portion 510 is rotatably coupled to the first end 532 of the second body portion 530. More specifically, the second end 514 of the first body portion 510 includes an opening 516, while the first end 532 of the second body portion 530 includes an extension 533, which extends through the opening 516 of the first body portion 510, and a disc member 535 coupled to the extension 533 and disposed within the first body portion 510. The first body portion 510 rotates about the extension 533 with respect to the second body portion 510.

As further illustrated, the first body portion 510 also includes primary movable members or jaws 520 disposed on the first end 512 of the first body portion 510, and secondary movable members or wings 522 extending outwardly from the first body portion 510 between the first end 512 and the second end 514 of the first body portion 510. As described in more detail below, the jaws 520 of the interactive object 500 may be configured to open and close repeatedly as the interactive object spirals downwardly along the helical track 240 of the pillar 220. Also described in more detail below, the wings 522, similarly, are configured to repeatedly flap up and down with respect to the first body portion 510 as the interactive object 500 spirals downwardly along the helical track 240 of the pillar 220.

As illustrated in FIG. 2B, the interactive object 500 is movably coupled to the pillar 220 via the second body portion 530 of the interactive object 500. More specifically, and as best illustrated in FIG. 3, the second body portion 530 includes an opening 536 that extends through the second body portion 530 proximate to the first end 532 of the second body portion 530. The pillar 220 extends through the opening 536 such that the second body portion 530 at least partially encompasses, encases, and surrounds a portion of the pillar 220. FIG. 2B further illustrates that the second body portion 530 includes a groove 538 that is disposed on the exterior surface of the second body portion 530 and disposed around the opening 536. The release mechanism 230 of the tower 200 is configured to engage the groove 538 to retain the interactive object 500 proximate to the top end 222 of the pillar 220 until the release mechanism 230 is actuated to release the interactive object 500.

As illustrated in FIGS. 3 and 4, disposed within the second body portion 530 is an engagement mechanism 550 that is configured to engage the helical track 240 of the pillar 220 and release the interactive object 500 from the helical track 240 when actuated. The engagement mechanism 550 includes a movable support plate 560 disposed proximate to the opening 536 of the second body portion 530. The moveable support plate 560 contains a first end 562 and a second end 564 opposite the first end 562. As illustrated, an engagement wheel 566 is disposed proximate to the first end 562 of the moveable support plate 560, where the engagement wheel 566 is configured to rotate with respect to the support plate 560 and the second body portion 530 about axis B. The engagement wheel 566 includes a roller portion 566*a* and a geared portion 566*b*. FIG. 4 illustrates that the geared portion 566*b* of the engagement wheel 566 is intermeshed with another gear wheel 568 that is disposed centrally on the support plate 560 between the first end 562 and the second end 564 of the support plate 560. The gear wheel 568 is rotatably coupled to the support plate 560 via an axle 569 that also extends through the support plate 560 to the housing of the second body portion 530. The support plate 560 further includes an upstanding shaft 570 that extends vertically from the second end 564 of the support plate 560. A resilient member 572 is coupled to the upstanding shaft 570 and the housing of the second body portion 530. The support plate 560 is configured translate or rotate about the axle 569 and axis C that extends coaxially through the axle 569 between an engaged position, where the roller portion 566*a* of the engagement wheel 566 is at least partially disposed within the opening 536 of the second body portion 530 and configured to engage the helical track 240 of the pillar 220 of the tower 200, and a disengaged position, where the roller portion 566*a* of the engagement wheel 566 is not disposed within the opening 536 of the second body portion 530 and not capable of engaging the helical track 240 of the pillar 220 of the tower 200 (i.e., disengaged with the helical track 240). The support plate 560 is oriented in the disengaged position in FIG. 4. Moreover, the resilient member 572 biases the support plate 560 to the disengaged position.

As further illustrated in FIG. 4, the engagement mechanism 550 includes a trigger or actuator 574 and a release member 576. Both the trigger 574 and the release member 576 extend outwardly from the first end 532 of the second body portion 530. The trigger 574 is operatively coupled to the support plate 560, and is repositionable between an actuated position (shown in FIG. 4), which allows the resilient member 572 to bias the support plate 560 to the disengaged position, and an unactuated position, where the trigger 574 forces the support plate 560 into the engage position. The trigger 574 is configured to translate vertically with respect to the housing of the second body portion 530 between the actuated position and the unactuated position. The release member 576 may be operatively coupled to the trigger 574 and/or the support plate 560 such that the release member 576 is configured to translate between a first position and a second position, where the release member 576 translates horizontally with respect to the housing of the second body portion 530. While not illustrated, when the first end 532 of the second body portion 530 is fully coupled to the second end 514 of the first body portion 510, the release member 576 at least partially extends into the second end 514 of the first body portion 510. The release member 576 may be operatively coupled to the trigger 574 and/or the support plate 560 such that, when the trigger 574 is in the unactuated position and the support plate 560 is in the engaged position, the release member 576 is in the first position and at least partially engaged with the second end 514 of the first body portion 510 to retain the first body portion 510 in the aligned position. Conversely, when the trigger 574 is in the actuated position and the support plate 560 is in the disengaged position, the release member 576 is in the second position and no longer engaged with the second end 514 of the first body portion 510 to enable the first body portion 510 to rotate with respect to the second body portion 530 to a misaligned position.

Continuing with FIGS. 5 and 6, disposed primarily within the first body portion 510 is a gearbox mechanism 580. The gearbox mechanism 580 includes a shaft 582 that extends outwardly from the gearbox mechanism 580 through the second end 514 of the first body portion 510 and the extension 533 of the first end 512 of the second body portion 530. The gearbox mechanism 580 also includes a series of outer gears 584 that are coupled to the shaft 582, where both the outer gears 584 and the shaft 582 are configured to rotate with respect to the housing of the gearbox mechanism 580 itself. The outer gears 584 of the gearbox mechanism 580 are configured to intermesh with the gear wheel 568 of the support plate 560 of engagement mechanism 550 when the support plate 560 is in the engaged position and the roller portion 566*a* of the engagement wheel 566 is engaged with the helical track 240 of the pillar 220. The gearbox mechanism 580 may further include side moveable members 586, which are configured to operatively engage the wings or secondary movable members 522, and a forward moveable member 588, which is configured to operatively engage the jaws or primary movable members 520. Operation of the gearbox mechanism 580 causes the wings 522 to move up and down in a flapping motion, while also causing the jaws 520 to open and close in a chomping motion.

In operation, engagement of the roller portion 566*a* of the engagement wheel 566 with the helical track 240 of the pillar 220 as the interactive object 500 spirals around and descends the pillar 220 causes the engagement wheel 566 to rotate. Because the geared portion 566*b* of the engagement wheel 566 is intermeshed with the gear 568 of the support plate 560, and because the gear 568 of the support plate 560 is intermeshed with the outer gears 584 of the gearbox mechanism 580, rotation of the engagement wheel 566 causes the gearbox mechanism 580 to be operated. Thus, as the roller portion 566*a* of the engagement wheel 566 is rotated (e.g., due to the engagement of the roller portion 566*a* of the engagement wheel 566 with the helical track 240 of the pillar), the gearbox mechanism 580 is powered to move the wings 522 in the flapping motion and the jaws 520 in the chomping motion. The intermeshing between the geared portion 566*b* of the engagement wheel 566, the gear 568, the outer gears 584, and the gearbox mechanism 580 creates an inertia the causes the interactive object 500 to swirl/rotate around and descend the pillar 220 along the helical track 240 at a controlled first speed. This controlled first speed is a slower speed (i.e., slower in both rotation of the interactive object 500 around the pillar 220 and slower in descent of the interactive object 500 from the top end 222 to the bottom end 224 of the pillar 220) than that of an interactive object that contains an engagement wheel 566 that is engageable with the helical track 240, but is not intermeshed with the other gears 568, 584, or gearbox mechanism 580, and descends the pillar 220 along the helical track 240 without being subject to an intermeshing gear inertia. For example, in one embodiment, if an interactive object that was not subject to an intermeshing gear inertia completed a full rotation of the pillar 220 about the helical track 240 every second, the interactive object 500 disclosed herein, which is subject to the intermeshing gear inertia, may complete a full rotation of the pillar 220 about the helical track 240 every six seconds. Continuing with this example, the interactive object that is not subject to an intermeshing gear inertia may complete a full descent of the pillar 220 via the helical track 240 in four seconds, while the interactive object 500 disclosed herein, which is subject to the intermeshing gear inertia to descend at a controlled first speed, may complete a full descent of the pillar 220 via the helical track 240 in twenty four seconds. Conversely, when the trigger 574 is actuated and the engagement wheel 566 and support plate 560 are rotated to the disengaged position, the interactive object 500 is configured to free fall or slide linearly down the pillar 220 via gravity along axis A to the bottom end 224 of the pillar 220, and without spinning around the pillar 220, at a free falling second speed. This free falling second speed is faster than the controlled first speed.

As best illustrated in FIG. 6, disposed within the interior of the first body portion 510 is a resilient member 590. The resilient member 590 is coupled to the gearbox mechanism 580 and the disc member 535 of the first end 532 of the second body portion 530 that is disposed within the interior of the first body portion 510. The resilient member 590 is configured to bias the first body portion 510 to rotate at least 90 degrees with respect to the second body portion 530 from the aligned position to the misaligned position. Specifically, when the trigger 574 is in the actuated position, the support plate 560 is in the disengaged position, and the release member 576 is in the second position and no longer engaged with the second end 514 of the first body portion 510, the resilient member 590 is free to bias the first body portion 510 into rotation from the aligned position to the misaligned position, where the first body portion 510 is rotated 90 degrees with respect to the second body portion 530.

Figure 7:
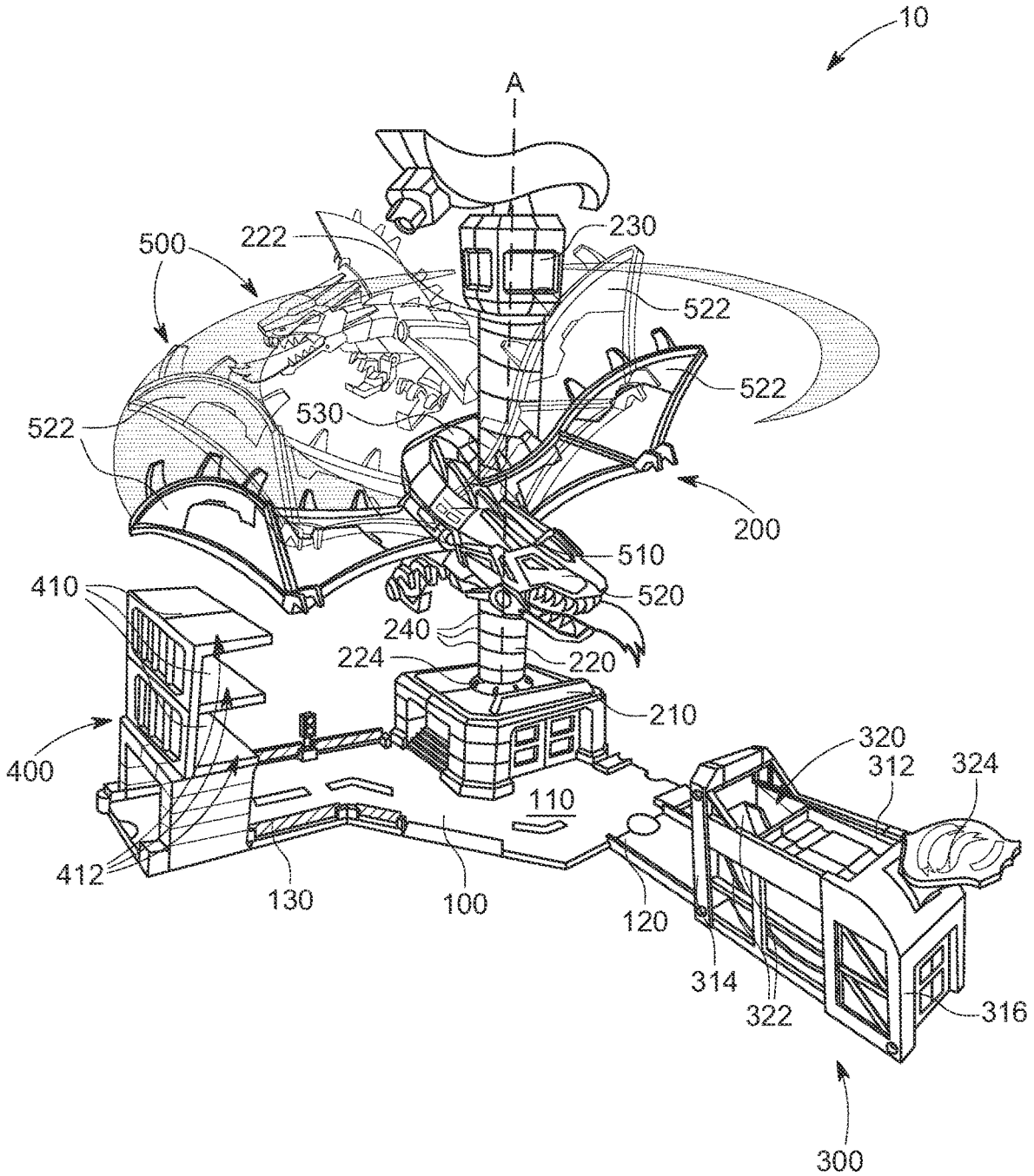
FIG. 7 illustrates a front perspective view of the embodiment of the toy vehicle playset illustrated in FIG. 1, and illustrates the movement path of the interactive object.

With reference to FIG. 7, illustrated is the interactive object 500 descending the pillar 220. As illustrated in FIG. 2B, the release mechanism 230 of the tower 200 is engaged with the groove 538 of the second body portion 530 of the interactive object 500 to retain the interactive object 500 at the top end 222 of the pillar 220. When the actuator 232 of the release mechanism 230 is actuated or depressed, the release mechanism 230 no longer engages with the groove 538 of the second body portion 530 of the interactive object 500, which leaves the interactive object 500 free to descend the pillar 220 as illustrated in FIG. 7. As illustrated in FIG. 7, the interactive object 500, when released from the release mechanism 230, descends the pillar 220 of the tower 200 from the top end 222 to the bottom end 224 via the path of the helical track 240. Thus, the interactive object 500 may spin around the pillar 220 a repeated number of times as it travels from the top end 222 to the bottom end 224 of the pillar. As previously explained, the interactive object 500 may descend the pillar 220 at the controlled first speed. When the interactive object 500 resembles a dragon, as illustrated in the embodiment of the toy vehicle playset illustrated in FIG. 7, the interactive object 500 spinning around the pillar 220 gives the appearance that the interactive object 500 is flying around the pillar 220.

Figure 8A:
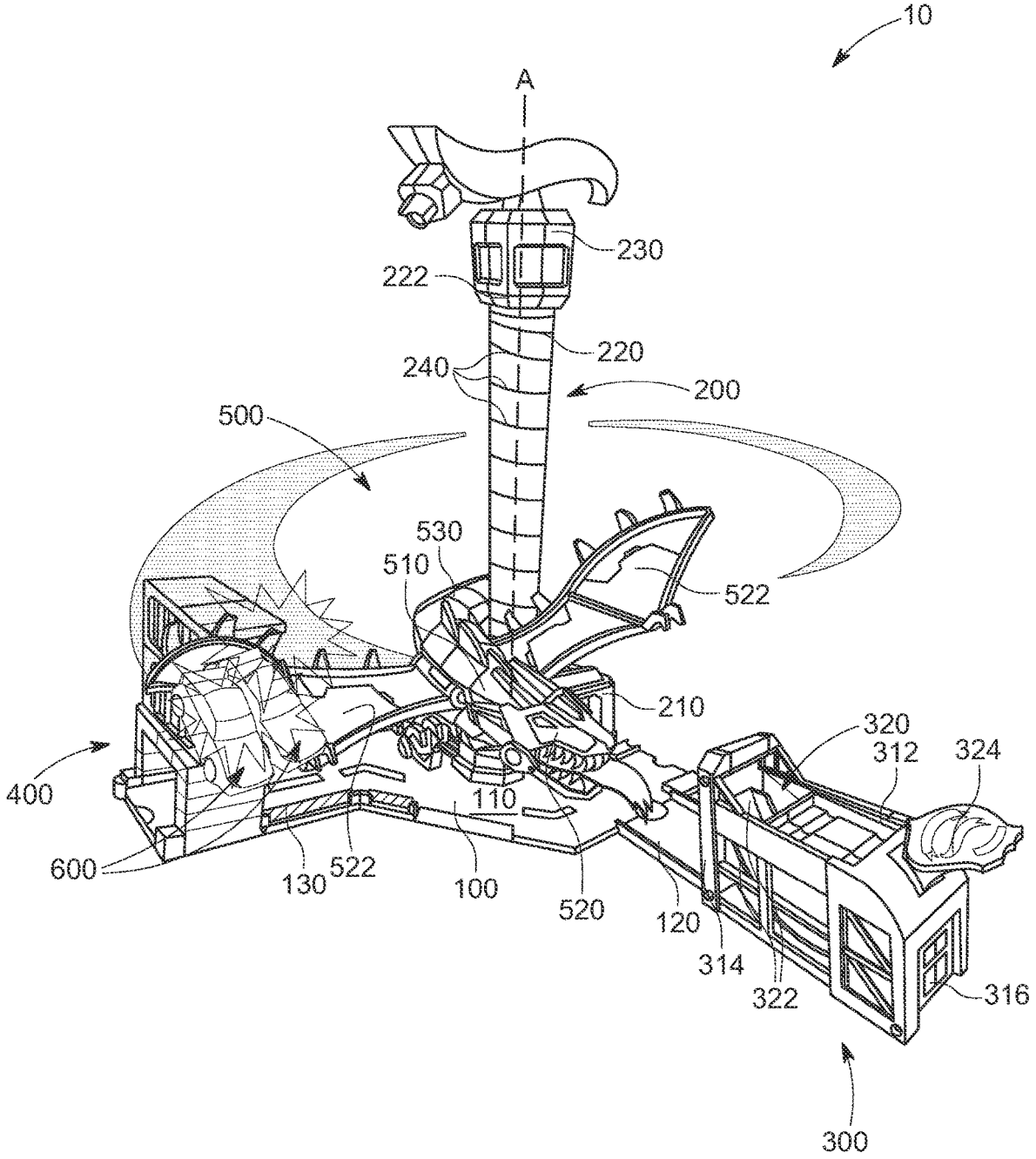
FIG. 8A illustrates a front perspective view the embodiment of the toy vehicle playset illustrated in FIG. 1 where the interactive object is impacting toy vehicles disposed on the housing structure with the first body portion of the interactive object.
Figure 8B:
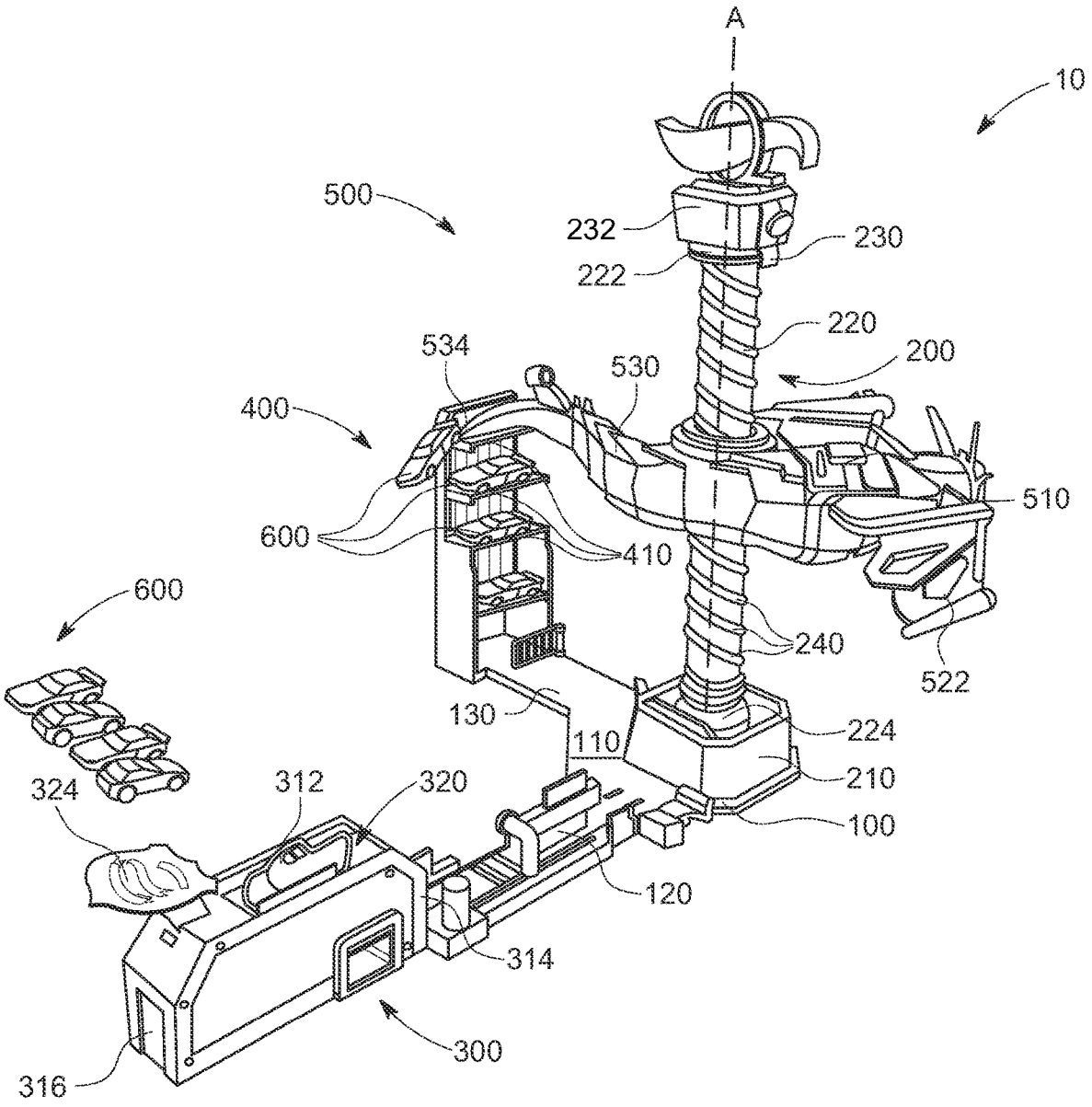
FIG. 8B illustrates a front perspective view the embodiment of the toy vehicle playset illustrated in FIG. 1 where the interactive object is impacting toy vehicles disposed on the housing structure with the second body portion of the interactive object.

Turning to FIGS. 8A and 8B, illustrated is the interactive object 500 impacting the toy vehicles 600 disposed on the toy vehicle playset 10. As illustrated in FIG. 8A, the interactive object 500 has spun around and descended the pillar 220 until the wings 522 have contacted the toy vehicles 600 disposed on at least one of the tiered platforms 410 of the housing structure 400. Conversely, as illustrated in FIG. 8B, the interactive object 500 has spun around and descended the pillar 220 until the second end 534 of the second body portion 530 (i.e., the end of the tail) of the interactive object 500 has contacted the toy vehicles 600 disposed on at least one of the tiered platforms 410 of the housing structure 400. In both illustrated scenarios, as the interactive object 500 spins around and descends the pillar 220 to contact the toy vehicles 600 in order to push the toy vehicles 600 off of their respective tiered platform 410 of the housing structure 400 (i.e., the interactive object 500 knocks the toy vehicles 600 off of the housing structure 400). These movements of the interactive object 500 and interaction with the toy vehicles 600 gives the appearance that the interactive object 500 "attacks" the toy vehicles 600 disposed in and on the housing structure 400.

Figure 9A:
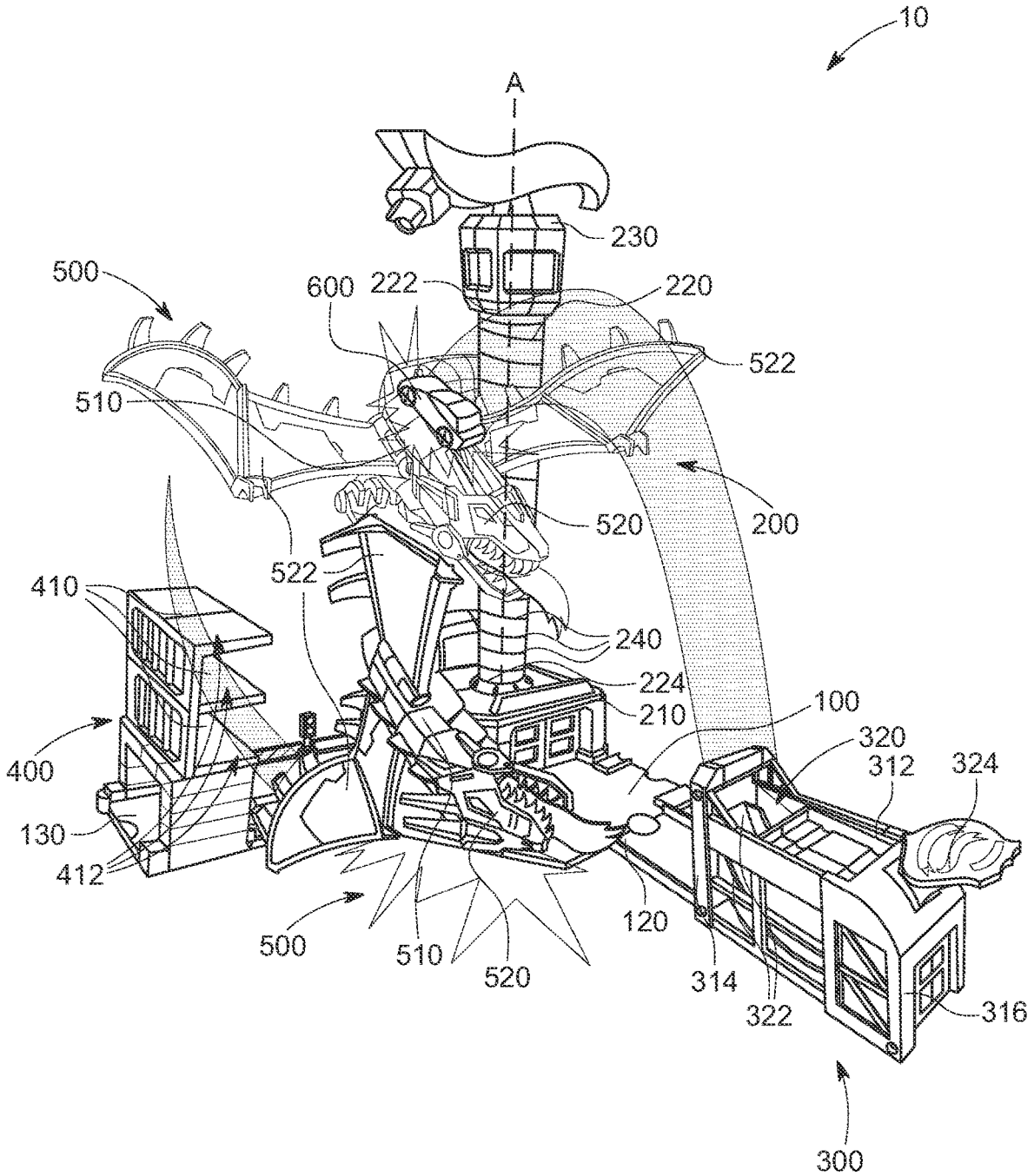
FIG. 9A illustrates a front perspective view of the embodiment of the toy vehicle playset illustrated in FIG. 1 and the pathway of a launched toy vehicle impacting the interactive object to disengage the interactive object from the tower.
Figure 9B:
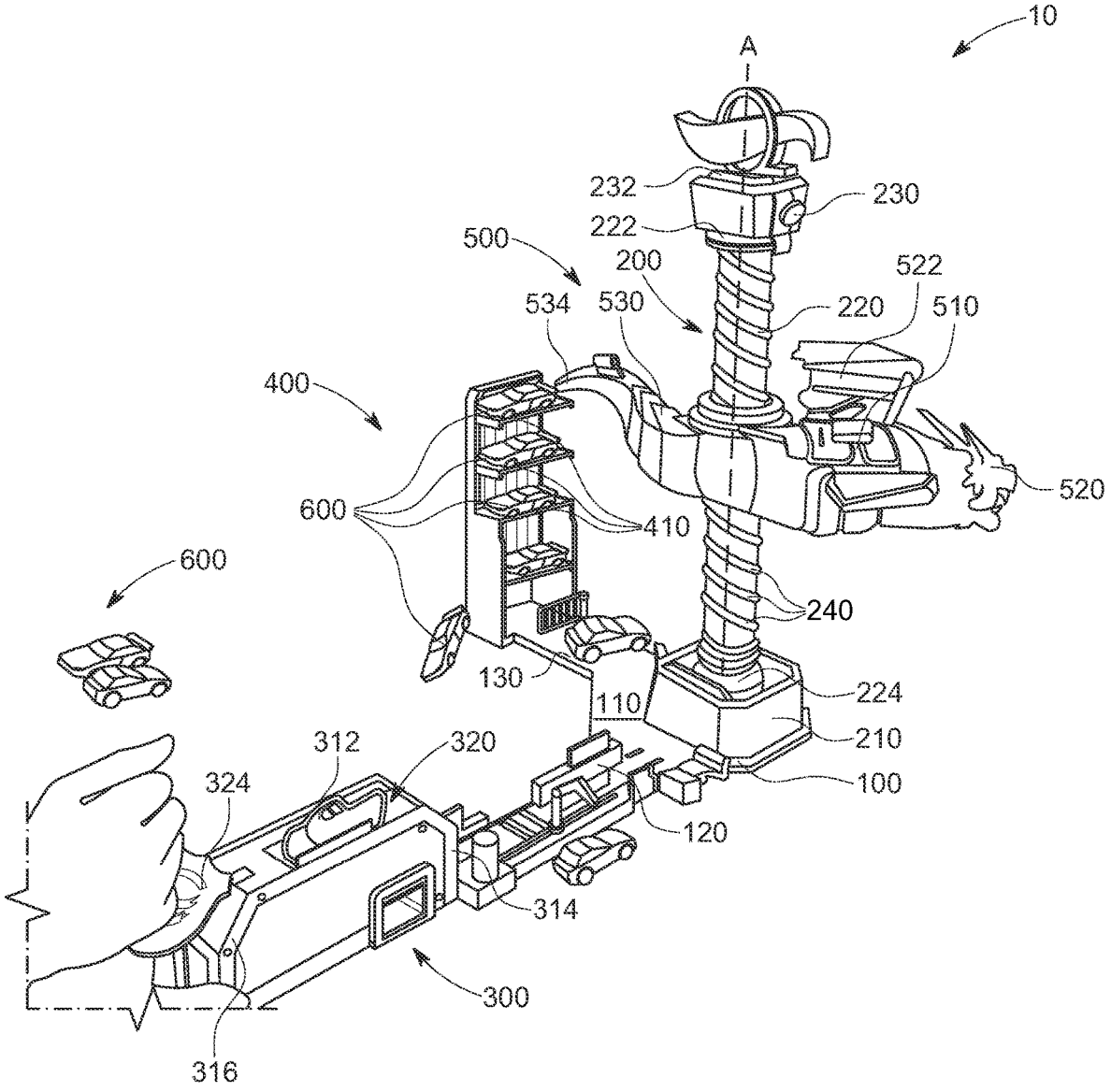
FIG. 9B illustrates a rear perspective view of the embodiment of the toy vehicle playset illustrated in FIG. 1 and the position of the toy vehicle immediately after being launched from the launcher.
Figure 9C:
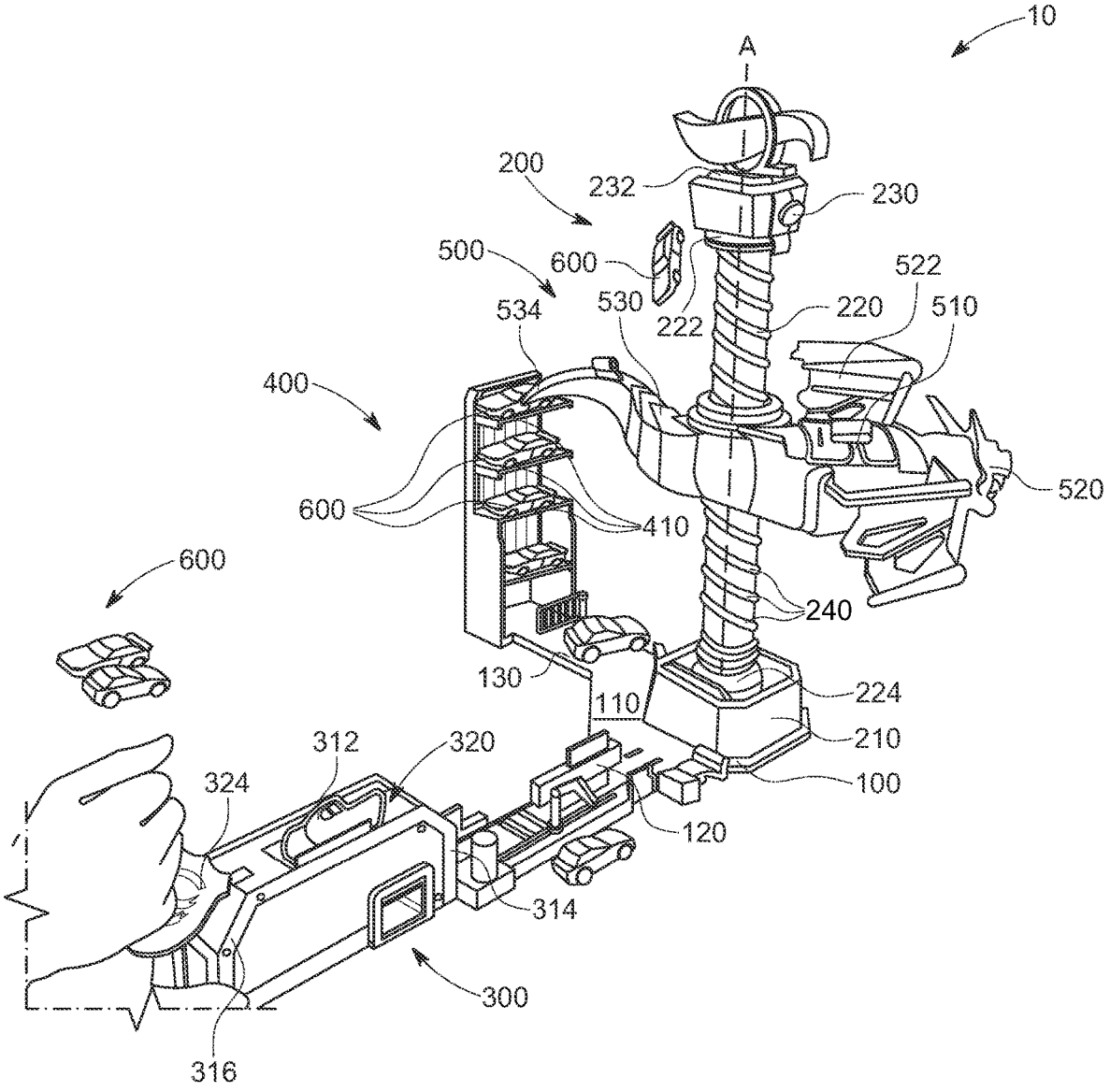
FIG. 9C illustrates a rear perspective view of the embodiment of the toy vehicle playset illustrated in FIG. 1 and the intermediate position of the toy vehicle during the launch profile of the toy vehicle.
Figure 9D:
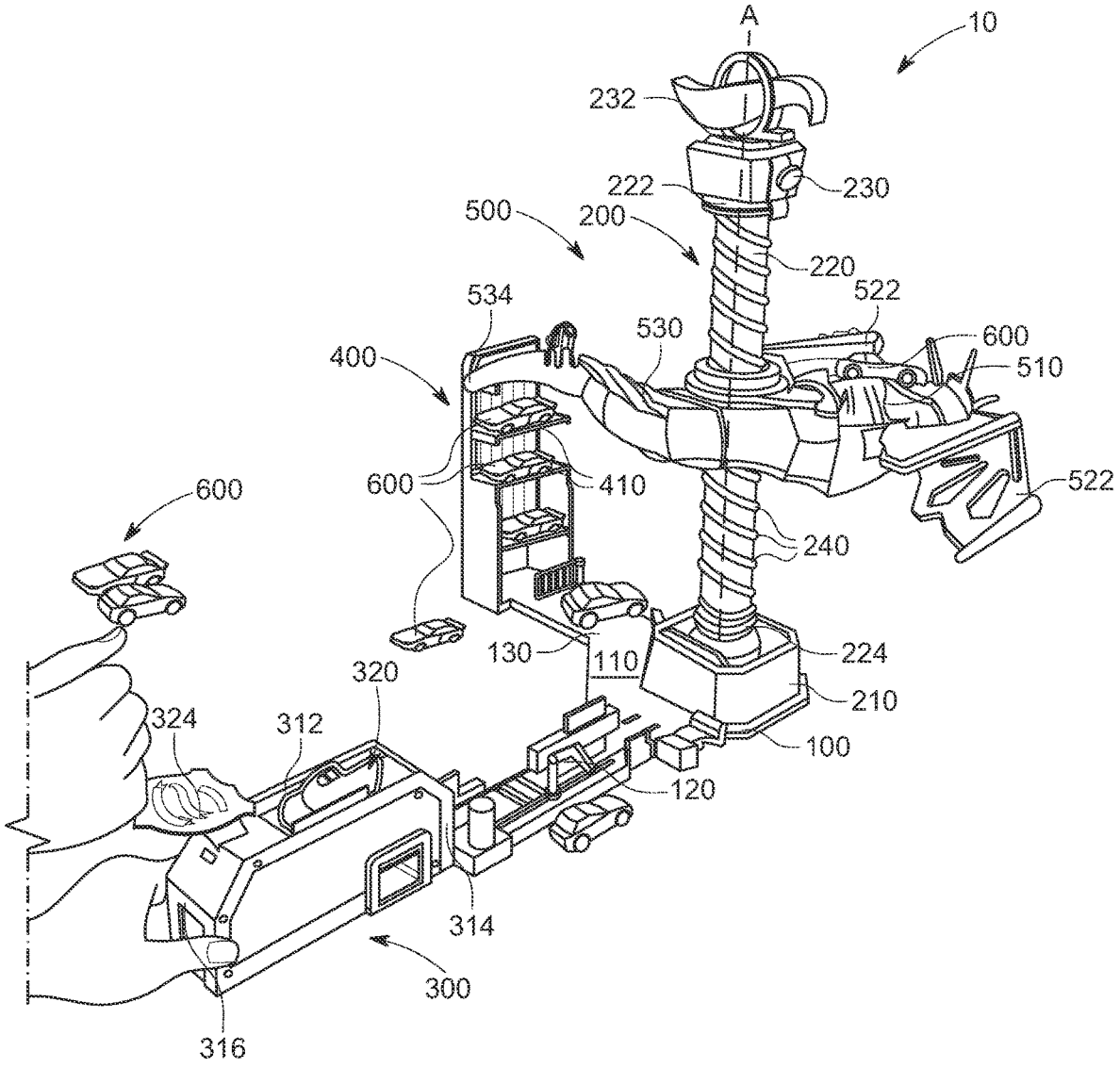
FIG. 9D illustrates a rear perspective view of the embodiment of the toy vehicle playset illustrated in FIG. 1 and the toy vehicle striking the interactive object to cause the interactive object to disengage from the tower.
Figure 9E:
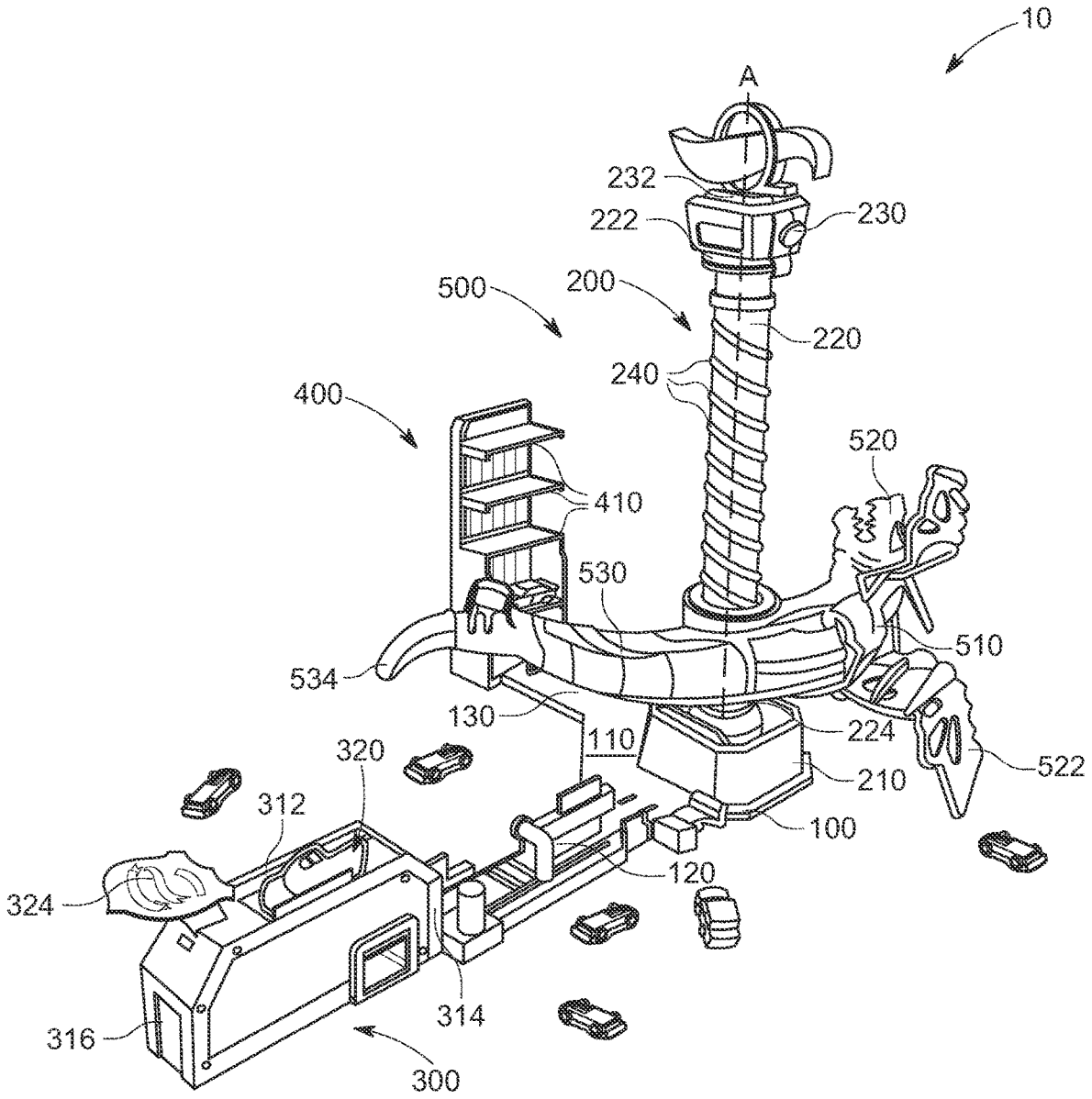
FIG. 9E illustrates a rear perspective view of the embodiment of the toy vehicle playset illustrated in FIG. 1 and the interactive object being disengaged from the tower and in the lowered position.

Turning to FIGS. 9A-9E, illustrated are additional play patterns of the illustrated embodiment of the toy vehicle playset 10, where the user may use the launcher 300 to launch a toy vehicle 600 towards a descending interactive object 500 to stop or prevent the interactive object 500 from "attacking" or knocking the toy vehicles 600 off of the housing structure 400 as it descends. The interactive object 500 descending the pillar 220 at the controlled first speed enables a user to have multiple attempts to use the launcher 300 to launch a toy vehicle 600 towards the descending interactive object 500. As previously explained, a toy vehicle 600 may be disposed within the launcher 300 for launching towards the interactive object 500 and the tower 200. As best illustrated in FIGS. 9B and 9C, with a toy vehicle 600 disposed within the launcher 300, a user of the toy vehicle playset 10 may strike the actuator 324 of the launcher 300 to cause the toy vehicle 600 to be propelled along the launching ramp 322 and through the opening 320 of the launcher 300. As best illustrated in FIGS. 9A and 9D, if timed properly, the launched toy vehicle 600 may strike or land on the top of the interactive object 500 proximate to the first body portion 510 of the interactive object 500. If the launched toy vehicle 600 strikes the correct position on the top of the interactive object 500, the launched toy vehicle 600 may strike the trigger 574 of the engagement mechanism 550 to actuate the trigger 574 of the engagement mechanism 550. As previously explained, when the trigger 574 is actuated, the trigger 574 is repositioned to the actuated position, which causes the resilient member 572 to rotate the support plate 560 to the disengaged position. This, in turn, causes the engagement wheel 566 to be disengaged from the helical track 240 of the pillar 220. Disengagement of the engagement wheel 566 from the helical track 240 causes the interactive object 500 to free fall or slide linearly down the pillar 220 along axis A to the bottom end 224 of the pillar 220 without spinning around the pillar 220. Moreover, the interactive object 500 free falls down the pillar 220 along axis A at the free fall second speed. Simultaneously, as the trigger 574 is actuated and repositioned to the actuated position, the release member 576 is repositioned to the second position, which frees the biasing force of the resilient member 590 to rotate the first body portion 510 to the misaligned position (best shown in FIG. 9E). In other words, if the launched toy vehicle 600 strikes the interactive object 500 in the correct location such that the trigger 574 is actuated, the first body portion 510 rotates to the misaligned position (i.e., rotated 90 degrees with respect to the second body portion 530) with the second body portion 530, and the interactive object 500 drops or free falls to the bottom end 224 of the pillar 220 at the free falling second speed. These actions give the appearance that the launched toy vehicle 600 has "defeated" the interactive object 500, and has "saved" the toy vehicles 600 remaining in the housing structure 400 from the interactive object 500 by preventing the interactive object 500 from knocking the remaining toy vehicles 600 out of the housing structure 400.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A toy vehicle playset comprises:

a base, a tower coupled to the base, the tower including a track disposed about the tower;

an object moveably coupled to the tower, the object being equipped with an actuator and a mechanism that is repositionable between an engaged position, where the mechanism is engaged with the track of the tower, and a disengaged position, where the mechanism is disengaged from the track of the tower, wherein actuation of the actuator repositions the mechanism from the engaged position to the disengaged position; and a toy vehicle launcher coupled to the base, the toy vehicle launcher being configured to launch a toy vehicle at the object as the object descends the tower, the toy vehicle launched by the toy vehicle launcher being configured to impact the object as the object descends the tower.

2. The toy vehicle playset of claim 1, wherein the track is a helical track.

3. The toy vehicle playset of claim 2, wherein, when the mechanism of the object is in the engaged position, the object is configured to spiral around the tower as the object descends the tower.

4. The toy vehicle playset of claim 3, wherein, when the mechanism of the object is in the disengaged position, the object is configured to fall vertically along the tower toward the base.

5. The toy vehicle playset of claim 1, wherein, when the toy vehicle launched by the toy vehicle launcher impacts the actuator of the object, the mechanism of the object is repositioned from the engaged position to the disengaged position.

6. The toy vehicle playset of claim 1, wherein the mechanism includes at least one gear configured to rotate when the mechanism is in the engaged position and the object descends the tower.

7. The toy vehicle playset of claim 6, wherein the object further includes at least one movable member that is operatively coupled to the at least one gear of the mechanism such that the at least one movable member is configured to perform a movement when the mechanism is in the engaged position and the object descends the tower along the track.

8. The toy vehicle playset of claim 1, wherein the object descends the tower at a first speed when the mechanism is in the engaged position and descends the tower at a second speed when the mechanism is in the disengaged position, the first speed being slower than the second speed due to the engagement of the mechanism with the track of the tower.

9. A toy vehicle playset comprises:

a base, a tower coupled to the base, the tower including a track disposed about the tower; and an object moveably coupled to the tower, the object including an actuator, a first portion, a second portion, and a resilient mechanism, the first portion being rotatably coupled to the second portion and configured to rotate between a first position and a second position, the resilient mechanism being configured to bias the first portion to the second position, the object being reconfigurable between a first configuration, where the object is configured to descend the tower along the track, and a second configuration, where the object is configured to linearly descend the tower, wherein actuation of the actuator reconfigures the object from the first configuration to the second configuration and actuates the resilient mechanism to bias the first portion from the first position to the second position.

10. The toy vehicle playset of claim 9, wherein the second portion includes an opening configured to receive the tower such that the second portion at least partially surrounds a portion of the tower.

11. The toy vehicle playset of claim 9, wherein the first portion in the second position is rotated approximately 90 degrees from the first position with respect to the second portion.

12. The toy vehicle playset of claim 9, wherein the second portion further includes an engagement mechanism that is repositionable between an engaged position, where the engagement mechanism is engaged with the track of the tower, and a disengaged position, where the engagement mechanism is disengaged from the track of the tower, wherein actuation of the actuator repositions the engagement mechanism from the engaged position to the disengaged position.

13. The toy vehicle playset of claim 12, wherein, when the engagement mechanism is repositioned to the disengaged position, the resilient mechanism biases the first portion of the object to the second position.

14. The toy vehicle playset of claim 9, further comprising a launcher configured to launch a projectile at the object as the object descends the tower in the first configuration.

15. The toy vehicle playset of claim 14, wherein the actuator is actuated when the projectile launched from the launcher impacts the actuator of the object.

* * * * *